US005521465A

United States Patent [19]

Budzilek et al.

[11] Patent Number: 5,521,465

[45] Date of Patent: May 28, 1996

[54] SUNLIGHT VIEWABLE THIN FILM ELECTROLUMINSCENT DISPLAY HAVING DARKENED METAL ELECTRODES

[75] Inventors: Russell A. Budzilek, Bridgeport; Dominic L. Monarchie, Norwalk, both of Conn.; Elliot Schlam, Wayside, N.J.; Richard R. Swatson, Trumbull, Conn.

[73] Assignee: Westinghouse Norden Systems Inc., Norwalk, Conn.

[21] Appl. No.: 319,355

[22] Filed: Oct. 6, 1994

Related U.S. Application Data

[63] Continuation of Ser. No. 990,322, Dec. 14, 1992, abandoned.

[51] Int. Cl.[6] ..... H01J 1/62; H01J 63/04

[52] U.S. Cl. ..... 313/503; 313/505; 313/506; 313/509

[58] Field of Search ..... 313/498, 503, 313/506, 505, 509

[56] References Cited

U.S. PATENT DOCUMENTS

| | | | |
|---|---|---|---|
| 1,912,560 | 6/1933 | Wiles | 313/355 |
| 3,560,784 | 2/1971 | Steele et al. | 313/92 |
| 4,287,449 | 9/1981 | Takeda et al. | 313/509 |
| 4,289,384 | 9/1981 | Samek | 350/392 |
| 4,547,702 | 10/1985 | Schrank | 313/509 |
| 4,602,189 | 7/1986 | Panicker | 313/505 |
| 4,613,793 | 9/1986 | Panicker et al. | 315/169.3 |
| 4,740,781 | 4/1988 | Brown | 340/712 |
| 4,758,765 | 7/1988 | Mitsumori | 313/506 |
| 4,963,788 | 10/1990 | King et al. | 313/503 |
| 5,162,933 | 11/1992 | Kakuda et al. | 359/59 |
| 5,163,220 | 11/1992 | Zeto et al. | 29/846 |
| 5,361,153 | 11/1994 | Shimamune et al. | 359/87 |

FOREIGN PATENT DOCUMENTS

| | | | |
|---|---|---|---|
| 0483783 | 5/1992 | European Pat. Off. . | |
| 54-107292 | 8/1979 | Japan | 313/509 |
| WO93/26139 | 12/1993 | WIPO . | |

OTHER PUBLICATIONS

U. G. Gerber and V. Marrello, AC Electroluminescent Devices Having a Black Electrode, Sep. 1977, p. 1561, vol. 20, No. 4, IBM Technical Disclosure Bulletin.

Gregory, O. J., Zeto, R. J., Hryckowian, Burbank, K. A., "Fabrication of High–Conductivity, Transparent Electrodes with Trenched Metal Bus Lines", J. Electrochem. Soc., vol. 138, No. 7, Jul. 1991, pp. 2070–2075.

J. Haaranen, R. Tornqvist, J. Koponen, T. Pitkanen, M. Surma–aho, W. Barrow, C. Laakso; *19.3: A 9–in.–Diagonal High–Contrast Multicolor TFEL Display*; SID 92 Digest pp. 348–351.

*Primary Examiner*—Anita Pellman Gross
*Assistant Examiner*—Walter Malinowski
*Attorney, Agent, or Firm*—C. O. Edwards

[57] ABSTRACT

An AC thin film electroluminescent display panel includes a metal assist structure formed on and in electrical contact over each transparent electrode, and light absorbing darkened rear electrodes which combine to provide a sunlight viewable display panel.

16 Claims, 2 Drawing Sheets

SUNLIGHT VIEWABLE THIN FILM ELECTROLUMINSCENT DISPLAY HAVING DARKENED METAL ELECTRODES

CROSS REFERENCE TO RELATED APPLICATIONS

This is a continuation of application Ser. No. 07/990,322 filed Dec. 14, 1992, now abandoned.

This application contains subject matter related to commonly assigned co-pending applications: Ser. No. 07/897,201 filed Jun. 11, 1992, entitled "Low Resistance, Thermally Stable Electrode Structure for Electroluminescent Displays"; Ser. No. 07/990,991 designated attorney docket number N-1220, now U.S. Pat. No. 5,445,898, entitled "Sunlight Viewable Thin Film Electroluminescent Display"; and Ser. No. 07/989,672 designated attorney docket number N-1222, entitled "Sunlight Viewable Thin Film Electroluminescent Display Having A Graded Layer Of Light Absorbing Material".

TECHNICAL FIELD

This invention relates to electroluminescent display panels and more particularly to reducing the reflection of ambient light to enhance the sunlight viewability of the panels.

BACKGROUND ART

Thin film electroluminescent (TFEL) display panels offer several advantages over other display technologies such as cathode ray tubes (CRTs) and liquid crystal displays (LCDs). Compared with CRTs, TFEL display panels require less power, provide a larger viewing angle, and are much thinner. Compared with LCDs, TFEL display panels have a larger viewing angle, do not require auxiliary lighting, and can have a larger display area.

FIG. 1 shows a prior art TFEL display panel. The TFEL display has a glass panel 10, a plurality of transparent electrodes 12, a first layer of a dielectric 14, a phosphor layer 16, a second dielectric layer 18, and a plurality of metal electrodes 20 perpendicular to the transparent electrodes 12. The transparent electrodes 12 are typically indium-tin oxide (ITO) and the metal electrodes 20 are typically Al. The dielectric layers 14, 18 protect the phosphor layer 16 from excessive dc currents. When an electrical potential, such as about 200 V, is applied between the transparent electrodes 12 and the metal electrodes 20, electrons tunnel from one of the interfaces between the dielectric layers 14, 18 and the phosphor layer 16 into the phosphor layer where they are rapidly accelerated. The phosphor layer 16 typically comprises ZnS doped with Mn. Electrons entering the phosphor layer 16 excite the Mn causing the Mn to emit photons. The photons pass through the first dielectric layer 14, the transparent electrodes 12, and the glass panel 10 to form a visible image.

Although current TFEL displays are satisfactory for some applications, more advanced applications require brighter higher contrast displays, larger displays, and sunlight viewable displays. One approach in attempt to provide adequate panel contrast under high ambient illumination is the use of a circular polarizer filter which reduces ambient reflected light. While this approach may provide reasonable contrast in moderate ambient lighting conditions, it also has a number of drawbacks which include a high cost and a maximum light transmission of about 37%.

DISCLOSURE OF THE INVENTION

An object of the present invention is to reduce the reflection of ambient light and enhance the contrast of a TFEL display to provide a sunlight viewable display.

Another object of the present invention is to provide a large TFEL display with enhanced contrast.

Yet another object of the present invention is to provide a high resolution TFEL panel with enhanced contrast.

According to the present invention, darkened rear electrodes are included in the layered structure of a TFEL display panel having low resistance transparent electrodes to absorb light and increase the contrast of the display.

The present invention provides a TFEL display panel which is comfortably viewable in direct sunlight. Another feature of the present invention is, by employing light absorbing darkened rear electrodes in a TFEL display having low resistance electrodes (which allow the display to be driven at a faster rate), larger display sizes with enhanced contrast such as those greater than thirty-six inches are now feasible.

These and other objects, features and advantages of the present invention will become more apparent in light of the following detailed description of a preferred embodiment thereof, as illustrated in the accompanying drawings.

BEST MODE FOR CARRYING OUT THE INVENTION

In one embodiment, a layer of light absorbing dark material is included in an electroluminescent display panel to reduce the reflection of ambient light impinging on the display panel.

Figure 1:
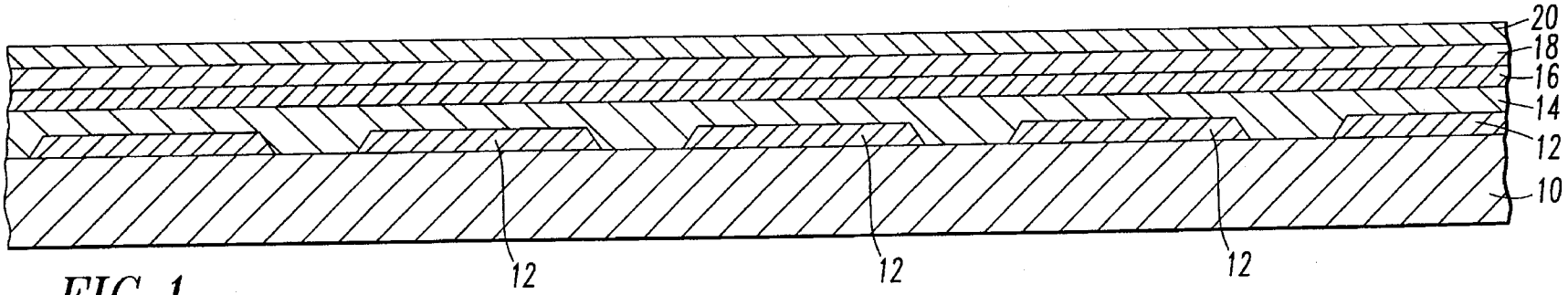
FIG. 1 PRIOR ART
FIG. 1 is a cross-sectional view of a prior art TFEL display.
Figure 2:
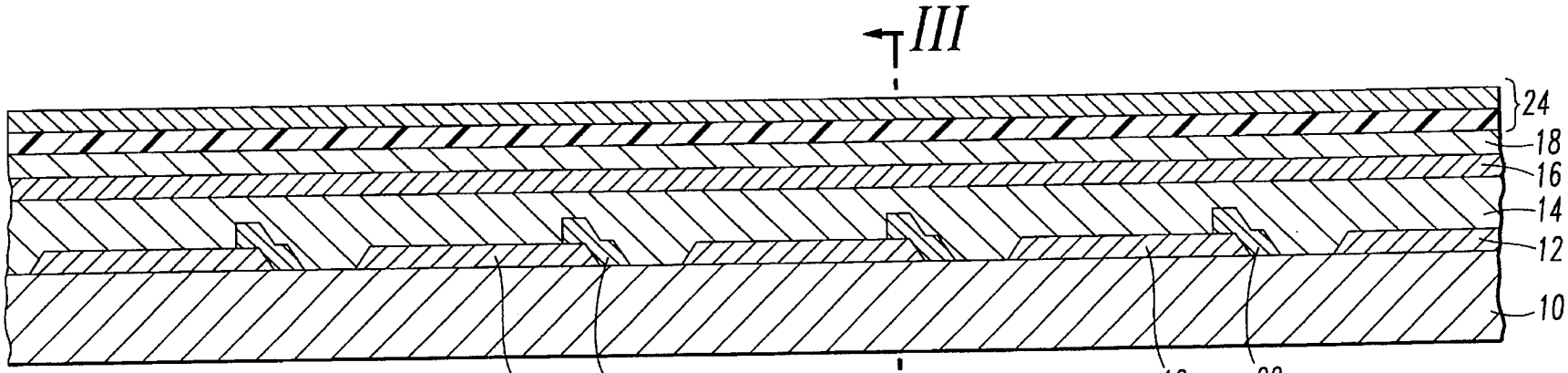
FIG. 2 is a cross-sectional view of a TFEL display having light absorbing darkened metal electrodes and low resistance transparent electrodes.

Referring to FIG. 2, a metal assist structure 22 is in electrical contact with a transparent electrode 12 and extends for the entire length of the electrode 12. The metal assist structure 22 can include one or more layers of an electrically conductive metal compatible with the transparent electrode 12 and other structures in the TFEL display panel. To decrease the amount of light transmissive area covered by the metal assist structure 22, the metal assist structure should cover only a small portion of the transparent electrode 12. For example, the metal assist structure 22 can cover about 10% or less of the transparent electrode 12. Therefore, for a typical transparent electrode 12 that is about 250 μm (10 mils) wide, the metal assist structure 22 should overlap the transparent electrode by about 25 μm (1 mil) or less. Overlaps as small as about 6 μm (0.25 mils) to about 13 μm (0.5 mils) are desirable. Although the metal assist structure 22 should overlap the transparent electrode 12 as little as possible, the metal assist structure should be as wide as practical to decrease electrical resistance. For example, a metal assist structure 22 that is about 50 μm (2 mils) to about 75 μm (3 mils) wide may be desirable. These two design parameters can be satisfied by allowing the metal assist structure 22 to overlap the glass panel 10 as well as the transparent electrode 12. With current fabrication methods, the thickness of the metal assist structure 22 should be equal to or less than the thickness of the first dielectric layer 16 to ensure that the first dielectric layer 16 adequately covers the transparent electrode 12 and metal assist structure. For example, the metal assist structure 22 can be less than about 250 nm thick. Preferably, the metal assist structure 22 will be less than about 200 nm thick, such as between about 150 nm and about 200 nm thick. However, as fabrication methods improve, it may become practical to make metal assist structures 22 thicker than the first dielectric layer 16.

Figure 3:
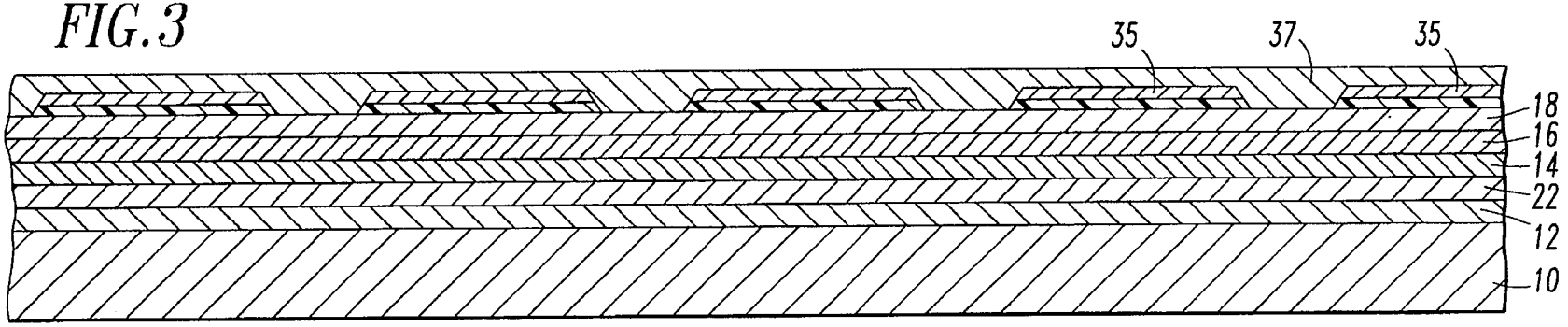
FIG. 3 is a cross-sectional view along the line AA of the TFEL display panel of FIG. 2 having darkened rear electrodes and low resistance transparent electrodes.

The TFEL display panel also includes a plurality of darkened rear electrodes 24 to reduce the amount of reflected ambient light from the panel and hence improve the display's contrast. Referring to FIG. 3, according to the present invention a TFEL display panel includes a plurality of darkened rear electrodes 24. FIG. 3 is a cross sectional view along the line AA of the display panel in FIG. 2. Preferably the rear electrodes 24 are Al, and are darkened by oxidization to achieve the required light absorption characteristics.

The darkened Al electrodes 24 can be fabricated by RF sputtering in an argon gas atmosphere. Mixing oxygen in the early stages of sputtering the Al layer to create the rear electrodes will oxidize (i.e., darken) a portion of the Al to create a layer of light absorbing dark material 34 in contact with the second dielectric layer 18. The remainder of the Al 35 that is not darkened is deposited in the conventional manner without the introduction of any oxygen. The thickness of the oxidized layer 34 can be varied as a function of the desired light absorption characteristics. In general however, the oxidized portion 34 of the rear electrodes 24 is a relatively small percentage of the total rear electrode thickness and therefore has little effect on the overall resistance of each rear electrode. As an example, when the oxidized layer 34 represents 10% of the total rear electrode thickness, the overall resistance of the rear electrode 24 will only increase about 11% (e.g., from about 126 ohms to about 140 ohms), assuming the following parameters:

Rear electrode length=4.7 inches

Rear electrode width=0.010 inches

Rear electrode thickness=1000 angstroms

Oxidization thickness=100 angstroms

Al resistivity=0.269 ohms/sq(1000 A)

To prevent the striped appearance that may exist from ambient light reflections off the glass panel 10 in between the rear electrodes 24, a black epoxy coating 37 is applied to the panel. The reflectivity and color of the epoxy coating 37 must be matched closely to the dark anodized surface of the darkened electrodes 24 to ensure a uniformly dark display. Preferably, the dark material should have a resistivity at least $10^8$ ohms/cm. The layer of dark material 24 should also have a dielectric constant which is at least equal to or greater than the dielectric constant of the second dielectric 18, and preferably have a dielectric constant greater than seven. In order to provide a diffuse reflectance of less than 0.5%, the dark material should also have a light absorption coefficient of about $10^5$/cm.

Figure 4:
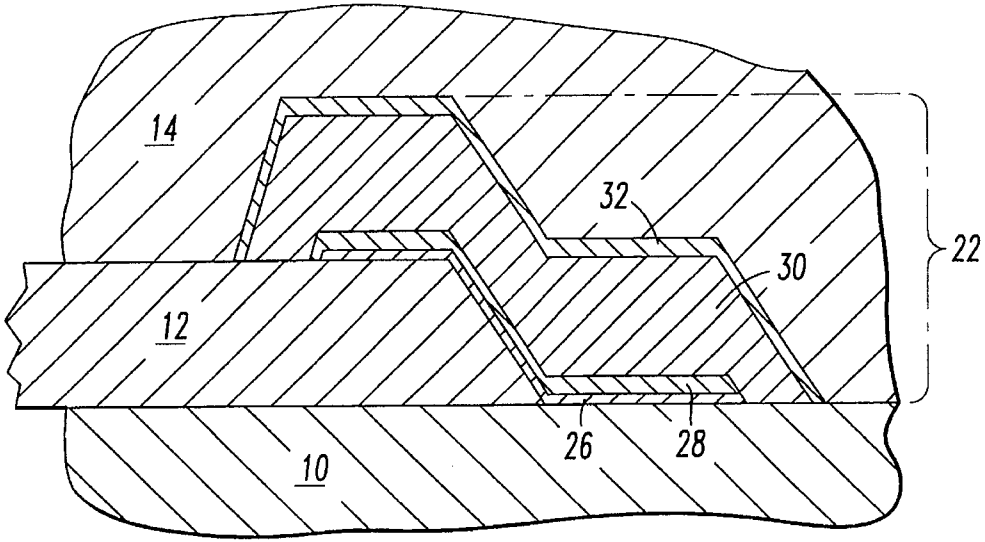
FIG. 4 is an enlarged cross-sectional view of a single ITO line and an associated metal assist structure of FIG. 2.

Referring to FIG. 4, a preferred embodiment of the metal assist structure 22 is a sandwich of an adhesion layer 26, a first refractory metal layer 28, a primary conductor layer 30, and a second refractory metal layer 32. The adhesion layer 26 promotes the bonding of the metal assist structure 22 to the glass panel 10 and transparent electrode 12. It can include any electrically conductive metal or alloy that can bond to the glass panel 10, transparent electrode 12, and first refractory metal layer 28 without forming stresses that may cause the adhesion layer 26 or any of the other layers to peel away from these structures. Suitable metals include Cr, V, and Ti. Cr is preferred because it evaporates easily and provides good adhesion. Preferably, the adhesion layer 26 will be only as thick as needed to form a stable bond between the structures it contacts. For example, the adhesion layer 26 can be about 10 nm to about 20 nm thick. If the first refractory metal layer 28 can form stable, low stress bonds with the glass panel 10 and transparent electrode 12, the adhesion layer 26 may not be needed. In that case, the metal assist structure 22 can have only three layers: the two refractory metal layers 28, 32 and the primary conductor layer 30.

The refractory metal layers 28, 32 protect the primary conductor layer 30 from oxidation and prevent the primary conductor layer from diffusing into the first dielectric layer 14 and phosphor layer 16 when the display is annealed to activate the phosphor layer as described below. Therefore, the refractory metal layers 28, 32 should include a metal or alloy that is stable at the annealing temperature, can prevent oxygen from penetrating the primary conductor layer 30, and can prevent the primary conductor layer 30 from diffusing into the first dielectric layer 14 or the phosphor layer 16. Suitable metals include W, Mo, Ta, Rh, and Os. Both refractory metal layers 28, 32 can be up to about 50 nm thick. Because the resistivity of the refractory layer can be higher than the resistivity of the primary conductor 30, the refractory layers 28, 32 should be as thin as possible to allow for the thickest possible primary conductor layer 30. Preferably, the refractory metal layers 28, 32 will be about 20 nm to about 40 nm thick.

The primary conductor layer 30 conducts most of the current through the metal assist structure 22. It can be any highly conductive metal or alloy such as Al, Cu, Ag, or Au. Al is preferred because of its high conductivity, low cost, and compatibility with later processing. The primary conductor layer 30 should be as thick as possible to maximize the conductivity of the metal assist structure 22. Its thickness is limited by the total thickness of the metal assist structure 22 and the thicknesses of the other layers. For example, the primary conductor layer 30 can be up to about 200 nm thick. Preferably, the primary conductor layer 30 will be about 50 nm to about 180 nm thick.

The TFEL display of the present invention can be made by any method that forms the desired structures. The transparent electrodes 12, dielectric layers 14, 18, phosphor layer 16 and metal electrodes 20 can be made with conventional methods known to those skilled in the art. The metal assist structure 22 can be made with an etch-back method, a lift-off method, or any other suitable method.

The first step in making a TFEL display like the one shown in FIG. 2 is to deposit a layer of a transparent conductor on a suitable glass panel 10. The glass panel can be any high temperature glass that can withstand the phosphor anneal step described below. For example, the glass panel can be a borosilicate glass such as Corning 7059 (Corning Glassworks, Corning, N.Y.). The transparent conductor can be any suitable material that is electrically conductive and has a sufficient optical transmittance for a desired application. For example, the transparent conductor can be ITO, a transition metal semiconductor that comprises about 10 mole percent In, is electrically conductive, and has an optical transmittance of about 85% at a thickness of about 200 nm. The transparent conductor can be any suitable thickness that completely covers the glass and provides the desired conductivity. Glass panels on which a suitable ITO layer has already been deposited can be purchased from Donnelly Corporation (Holland, Mich.). The remainder of the procedure for making a TFEL display of the present invention will be described in the context of using ITO for the transparent electrodes. One skilled in the art will recognize that the procedure for a different transparent conductor would be similar.

ITO electrodes 12 can be formed in the ITO layer by a conventional etch-back method or any other suitable method. For example, parts of the ITO layer that will become the ITO electrodes 12 can be cleaned and covered with an etchant-resistant mask. The etchant-resistant mask can be made by applying a suitable photoresist chemical to the ITO layer, exposing the photoresist chemical to an appropriate wavelength of light, and developing the photoresist chemical. A photoresist chemical that contains 2-ethoxyethyl acetate, n-butyl acetate, xylene, and xylol as primary ingredients is compatible with the present invention. One such photoresist chemical is AZ 4210 Photoresist (Hoechst Celanese Corp., Somerville, N.J.). AZ Developer (Hoechst Celanese Corp., Somerville, N.J.) is a proprietary developer compatible with AZ 4210 Photoresist. Other commercially available photoresist chemicals and developers also may be compatible with the present invention. Unmasked parts of the ITO are removed with a suitable etchant to form channels in the ITO layer that define sides of the ITO electrodes 12. The etchant should be capable of removing unmasked ITO without damaging the masked ITO or glass under the unmasked ITO. A suitable ITO etchant can be made by mixing about 1000 ml $H_2O$, about 2000 ml HCl, and about 370 g anhydrous $FeCl_3$. This etchant is particularly effective when used at about 55° C. The time needed to remove the unmasked ITO depends on the thickness of the ITO layer. For example, a 300 nm thick layer of ITO can be removed in about 2 min. The sides of the ITO electrodes 12 should be chamfered, as shown in the figures, to ensure that the first dielectric layer 14 can adequately cover the ITO electrodes. The size and spacing of the ITO electrodes 12 depend on the dimensions of the TFEL display. For example, a typical 12.7 cm (5 in) high by 17.8 cm (7 in) wide display can have ITO electrodes 12 that are about 30 nm thick, about 250 μm (10 mils) wide, and spaced about 125 μm (5 mils) apart. After etching, the etchant-resistant mask is removed with a suitable stripper, such as one that contains tetramethylammonium hydroxide. AZ 400T Photoresist Stripper (Hoechst Celanese Corp.) is a commercially available product compatible with the AZ 4210 Photoresist. Other commercially available strippers also may be compatible with the present invention.

After forming ITO electrodes 12, layers of the metals that will form the metal assist structure are deposited over the ITO electrodes with any conventional technique capable of making layers of uniform composition and resistance. Suitable methods include sputtering and thermal evaporation. Preferably, all the metal layers will be deposited in a single run to promote adhesion by preventing oxidation or surface contamination of the metal interfaces. An electron beam evaporation machine, such as a Model VES-2550 (Airco Temescal, Berkeley, Calif.) or any comparable machine, that allows for three or more metal sources can be used. The metal layers should be deposited to the desired thickness over the entire surface of the panel in the order in which they are adjacent to the ITO.

The metal assist structures 22 can be formed in the metal layers with any suitable method, including etch-back. Parts of the metal layers that will become the metal assist structures 22 can be covered with an etchant-resistant mask made from a commercially available photoresist chemical by conventional techniques. The same procedures and chemicals used to mask the ITO can be used for the metal assist structures 22. Unmasked parts of the metal layers are removed with a series of etchants in the opposite order from which they were deposited. The etchants should be capable of removing a single, unmasked metal layer without damaging any other layer on the panel. A suitable W etchant can be made by mixing about 400 ml $H_2O$, about 5 ml of a 30 wt % $H_2O_2$ solution, about 3 g $KH_2PO_4$, and about 2 g KOH. This etchant, which is particularly effective at about 40° C., can remove about 40 nm of a W refractory metal layer in about 30 sec. A suitable Al etchant can be made by mixing about 25 ml $H_2O$, about 160 ml $H_3PO_4$, about 10 ml $HNO_3$, and about 6 ml $CH_3COOH$. This etchant, which is effective at room temperature, can remove about 120 nm of an Al primary conductor layer in about 3 min. A commercially available Cr etchant that contains $HClO_4$ and $Ce(NH_4)_2(NO_3)_6$ can be used for the Cr layer. CR-7 Photomask (Cyantek Corp., Fremont, Calif.) is one Cr etchant compatible with the present invention. This etchant is particularly effective at about 40° C. Other commercially-available Cr etchants also may be compatible with the present invention. As with the ITO electrodes 12, the sides of the metal assist structures 22 should be chamfered to ensure adequate step coverage.

The dielectric layers 14, 18 and phosphor layer 16 can be deposited over the ITO lines 12 and metal assist structures 22 by any suitable conventional method, including sputtering or thermal evaporation. The two dielectric layers 14, 18 can be any suitable thickness, such as about 80 nm to about 250 nm thick, and can comprise any dielectric capable of acting as a capacitor to protect the phosphor layer 16 from excessive currents. Preferably, the dielectric layers 14, 18 will be about 200 nm thick and will comprise SiON. The phosphor layer 16 can be any conventional TFEL phosphor, such as ZnS doped with less than about 1% Mn, and can be any suitable thickness. Preferably, the phosphor layer 16 will be about 500 nm thick. After these layers are deposited, the display should be heated to about 500° C. for about 1 hour to anneal the phosphor. Annealing causes Mn atoms to migrate to Zn sites in the ZnS lattice from which they can emit photons when excited.

After annealing the phosphor layer 16, darkened metal electrodes 24 are formed on the second dielectric layer 18. The metal electrodes 24 can be made from any highly conductive metal, such as Al. As with the ITO electrodes 12, the size and spacing of the darkened metal electrodes 24 depend on the dimensions of the display. For example, a typical 12.7 cm (5 in) high by 17.8 cm (7 in) wide TFEL display can have metal electrodes 24 that are about 100 nm thick, about 250 μm (10 mils) wide, and spaced about 125 μm (5 mils) apart. The darkened metal electrodes 24 should be perpendicular to the ITO electrodes 12 to form a grid.

In addition to the embodiments shown in FIGS. 2–4, the TFEL display of the present invention can have any other configuration that would benefit from the combination of low resistance electrodes and light absorbing darkened rear electrodes.

The present invention provides several benefits over the prior art. For example, the combination of low resistance electrodes and darkened rear electrodes make TFEL displays of all sizes capable of achieving higher contrast and higher brightness through increased refresh rate. This makes large TFEL displays, such as a display about 91 cm (36 in) by 91 cm feasible since low resistance electrodes can provide enough current to all parts of the panel to provide even brightness across the entire panel, and the darkened rear electrodes reduce the reflection of ambient light to improve the panel's contrast. A display with low resistance electrodes and darkened electrodes can be critical in achieving sufficient contrast to provide a directly sunlight viewable thin film electroluminescent display.

Although the invention has been shown and described with respect to a preferred embodiment thereof, it should be understood by those skilled in the art that various other changes, omissions, and additions may be made to the embodiments disclosed herein, without departing from the spirit and scope of the present invention.

We claim:

1. A sunlight viewable electroluminescent display panel, comprising:

a planar glass substrate;

a plurality of transparent glass electrodes deposited on said glass substrate;

a multilayered metal assist means which is formed on and in electrical contact with each of said transparent electrodes;

a first dielectric layer deposited on said plurality of transparent electrodes;

a layer of phosphorous material deposited on said first dielectric layer;

a second dielectric layer deposited on said layer of phosphor material;

a plurality of metal electrodes each deposited in parallel over said second dielectric layer, each of said metal electrodes further comprising:

an electrically conductive portion; and a layer of light absorbing material comprising about 10% of the total thickness of its associated metal electrode, wherein, said light absorbing material is positioned between said second dielectric material and said electrically conductive portion of said electrode.

2. The sunlight viewable electroluminescent display panel of claim 1 wherein each of said plurality of metal electrodes is Aluminum, and each of said layers of light absorbing dark material comprises oxidized Aluminum.

3. The sunlight viewable electroluminescent display panel of claim 2 further comprises a layer of black epoxy coating formed over each of said plurality of metal electrodes and exposed portions of said second dielectric layer.

4. The sunlight viewable electroluminescent display panel of claim 3 wherein the lengthwise edges of said metal assist means are chamfered.

5. The sunlight viewable electroluminescent display panel of claim 1 wherein each of said plurality of metal electrodes has a total thickness of about 1000 angstroms of which about 100 angstroms is due to the thickness of said light absorbing dark layer.

6. The sunlight viewable electroluminescent display panel of claim 1 wherein said metal assist means comprises a first refractory metal layer, a primary conductor layer formed on said first refractory layer, and a second refractory layer formed on said primary conductor layer such that said first and second refractory layers are capable of protecting said primary conductor layer from oxidation when the display is annealed.

7. The sunlight viewable electroluminescent display panel of claim 6, wherein said metal assist means further comprises an adhesion layer formed between said first refractory metal layer and said transparent electrode, said adhesion layer is capable of adhering to the transparent electrode and said first refractory metal layer.

8. The sunlight viewable electroluminescent display panel of claim 6 wherein said plurality of parallel transparent electrodes are formed of indium-tin oxide (ITO).

9. The sunlight viewable electroluminescent display panel of claim 8 wherein the lengthwise edges of said parallel transparent electrodes are chamfered.

10. The sunlight viewable electroluminescent display panel of claim 6 wherein each of said plurality of metal electrodes is Aluminum, and each of said layers of light absorbing dark material comprises oxidized Aluminum.

11. A sunlight viewable electroluminescent display panel, comprising:

a planar glass substrate;

a plurality of transparent electrodes made from indium-tin oxide (ITO) deposited on said glass substrate, each of said transparent electrodes having a metal assist structure in electrical contact with, and slightly atop and overlapping, a portion of said transparent electrodes wherein each of said metal assist structures comprises a first refractory metal layer, a primary conductor layer made from Al formed on said first refractory layer, and a second refractory metal layer formed on said primary conductor layer, said first and second refractory layers made from W;

a first dielectric layer deposited on said plurality of transparent electrodes;

a layer of phosphor material deposited on said first dielectric layer;

a second dielectric layer deposited on said layer of phosphorous material;

a plurality of rear electrodes each deposited in parallel over said second dielectric layer, each of said rear electrodes comprising a layer of light absorbing dark material between said second dielectric layer and the electrically conductive portion of said rear electrode, said rear electrodes formed from material selected from the group Al, Cu, Ag, and Au.

12. The sunlight viewable electroluminescent display panel of claim 11 wherein said primary conductor layer is about 50 nm to about 260 nm thick.

13. The sunlight viewable electroluminescent display panel of claim 11 wherein said first and second refractory layers are each about 20 nm to about 40 nm thick.

14. The sunlight viewable electroluminescent display panel of claim 11 wherein said metal assist structure further comprises an adhesion layer formed between said first refractory layer and said transparent electrode, said adhesion layer is capable of adhering to the transparent electrode and said first refractory layer.

15. The sunlight viewable electroluminescent display panel of claim 14 wherein said adhesion layer is formed of material from the group comprising Cr, V and Ti.

16. The sunlight viewable electroluminescent display panel of claim 11 wherein each of said plurality of rear electrodes is Aluminum, and each of said layers of light absorbing dark material comprises oxidized Aluminum.

* * * * *